United States Patent [19]

Gibson

[11] Patent Number: 4,498,374

[45] Date of Patent: Feb. 12, 1985

[54] SPACE-DEFINING MOUNTING FOR ROOM COOLERS

[76] Inventor: David C. Gibson, 321 S. Elm Ave., Webster Groves, Mo. 63119

[21] Appl. No.: 464,335

[22] Filed: Feb. 7, 1983

[51] Int. Cl.[3] ..... E06B 7/10

[52] U.S. Cl. ..... 98/94.2; 49/61; 52/202

[58] Field of Search ..... 98/94 R, 94 AC; 49/61, 49/70; 52/202; 312/101; 62/262

[56] References Cited

U.S. PATENT DOCUMENTS

| | | | |
|---|---|---|---|
| 2,826,472 | 3/1958 | Humphner | 98/94 AC X |
| 2,978,973 | 4/1961 | Sweedyk et al. | 98/94 AC |
| 3,328,929 | 7/1967 | Mullins | 52/202 |

*Primary Examiner*—Harold Joyce

*Attorney, Agent, or Firm*—Rogers, Eilers, Howell, Renner, Moore & Haferkamp

[57] ABSTRACT

A space-defining mounting for a window-type air-conditioning unit which holds that air-conditioning unit wholly external of both tracks of a double-hung window, and which also provides an insulating air space adjacent the lower sash of that double-hung window whenever that lower sash is closed.

9 Claims, 9 Drawing Figures

FIG. 1.
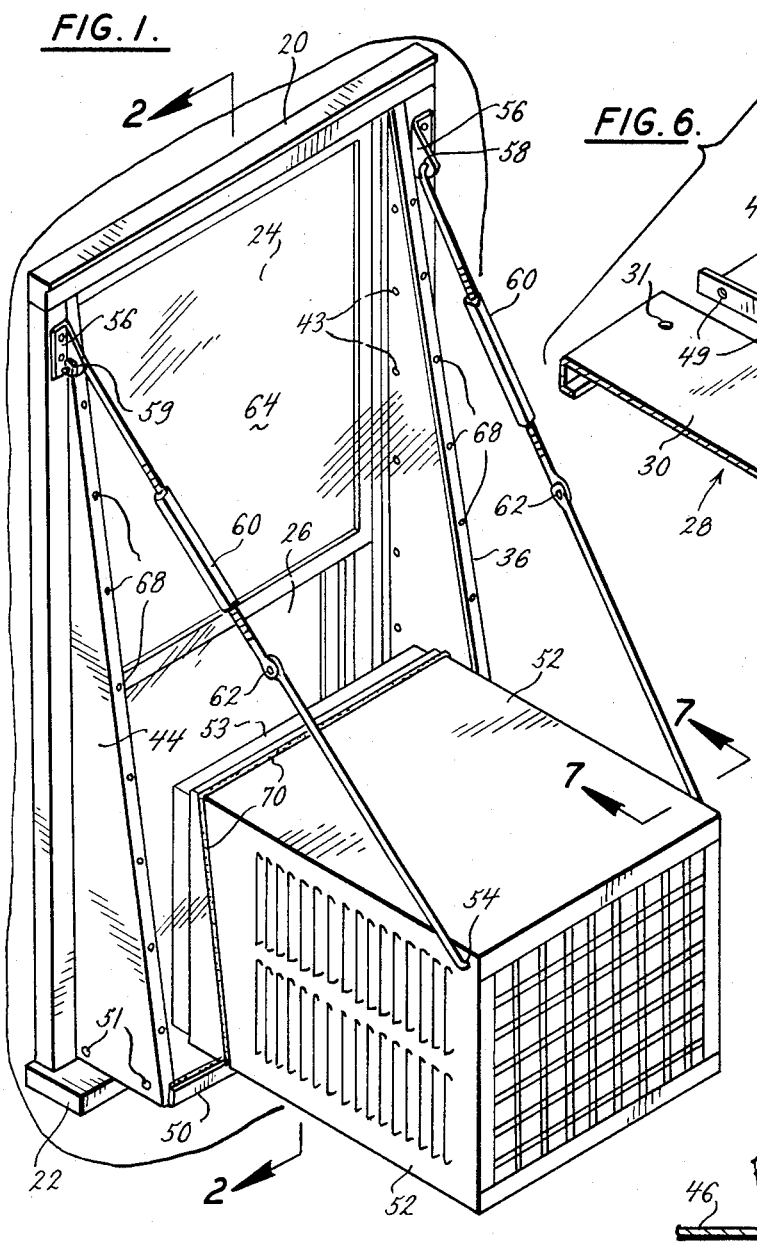
FIG. 6.
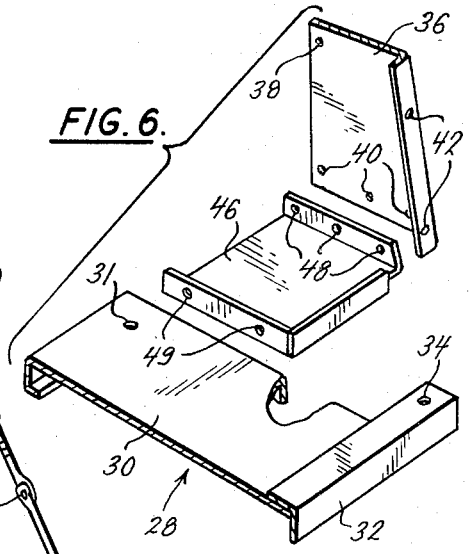
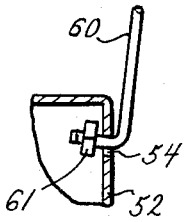
FIG. 7.
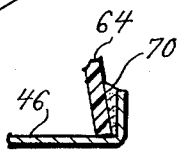
FIG. 5.
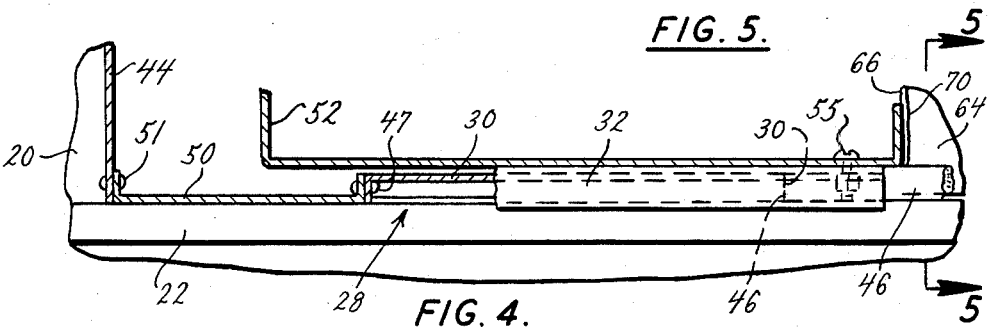
FIG. 4.

24
84
82
80
86
52
70
66
26
30
32
28
22
44
64
20
56
58
60
62
68
43
53
54
61
59
33
47
50
8
4

SPACE-DEFINING MOUNTING FOR ROOM COOLERS

BACKGROUND OF THE INVENTION

Window-type air conditioning units constitute inexpensive and readily-installed means for cooling rooms. However, prior mountings for such air conditioning units have not been completely satisfactory.

SUMMARY OF THE INVENTION

The present invention provides a space-defining mounting for a window-type air conditioning unit which holds that air conditioning unit wholly external of both tracks of a double-hung window. That mounting will permit either of the sashes of that double-hung window to be opened or closed as desired. That mounting will permit full and direct flow of cold air from the air conditioning unit into the room, and of return air from that room to the return-air inlet of that air conditioning unit, whenever the lower sash is in its raised position. However, when both sashes are in their closed positions, the mounting will define an insulating air space which resembles the insulating air space defined by a storm window. It is, therefore, an object of the present invention to provide a space-defining mounting for a window-type air conditioning unit which holds that air conditioning unit wholly external of both tracks of a double-hung window, and which provides an insulating air space whenever both sashes of that double-hung window are in their closed positions.

The mounting provided by the present invention can be installed by a person who is standing inwardly of the window adjacent which that mounting is to be installed. As a result, that mounting, and the air conditioning unit which it will support, can easily be installed in the windows of multi-story buildings. It is, therefore, an object of the present invention to provide a space-defining mounting for a window-type air conditioning unit which holds that air conditioning unit wholly external of both tracks of a double-hung window, and which can be installed by a person who is standing inwardly of that double-hung window.

Other and further objects and advantages of the present invention should become apparent from an examination of the drawing and accompanying description.

In the drawing and accompanying description, two preferred embodiments of the present invention are shown and described but it is to be understood that the drawing and accompanying description are for the purpose of illustration only and do not limit the invention and that the invention will be defined by the appended claims.

BRIEF DESCRIPTION OF THE DRAWING

In the drawing,

FIG. 1 is a perspective view of one preferred embodiment of space-defining mounting for room cooler which is provided by the present invention, FIG. 4 is a partially sectioned, front elevational view, on the scale of FIG. 2, of the lower part of the mounting of FIGS. 1 and 2, that is taken along the plane indicated by the line 4—4 in FIG. 2, FIG. 5 is a sectional view, on an even larger scale, which is taken along the plane indicated by the line 5—5 in FIG. 4, FIG. 6 is a perspective, exploded view, on the scale of FIG. 2, of part of the lower right-hand portion of the mounting of FIGS. 1 and 2, FIG. 7 is a sectional view, on the scale of FIG. 3, that is taken along the plane indicated by the line 7—7 in FIG. 1.

DESCRIPTION OF PREFERRED EMBODIMENT

Figures 2, 3, 8, 9:
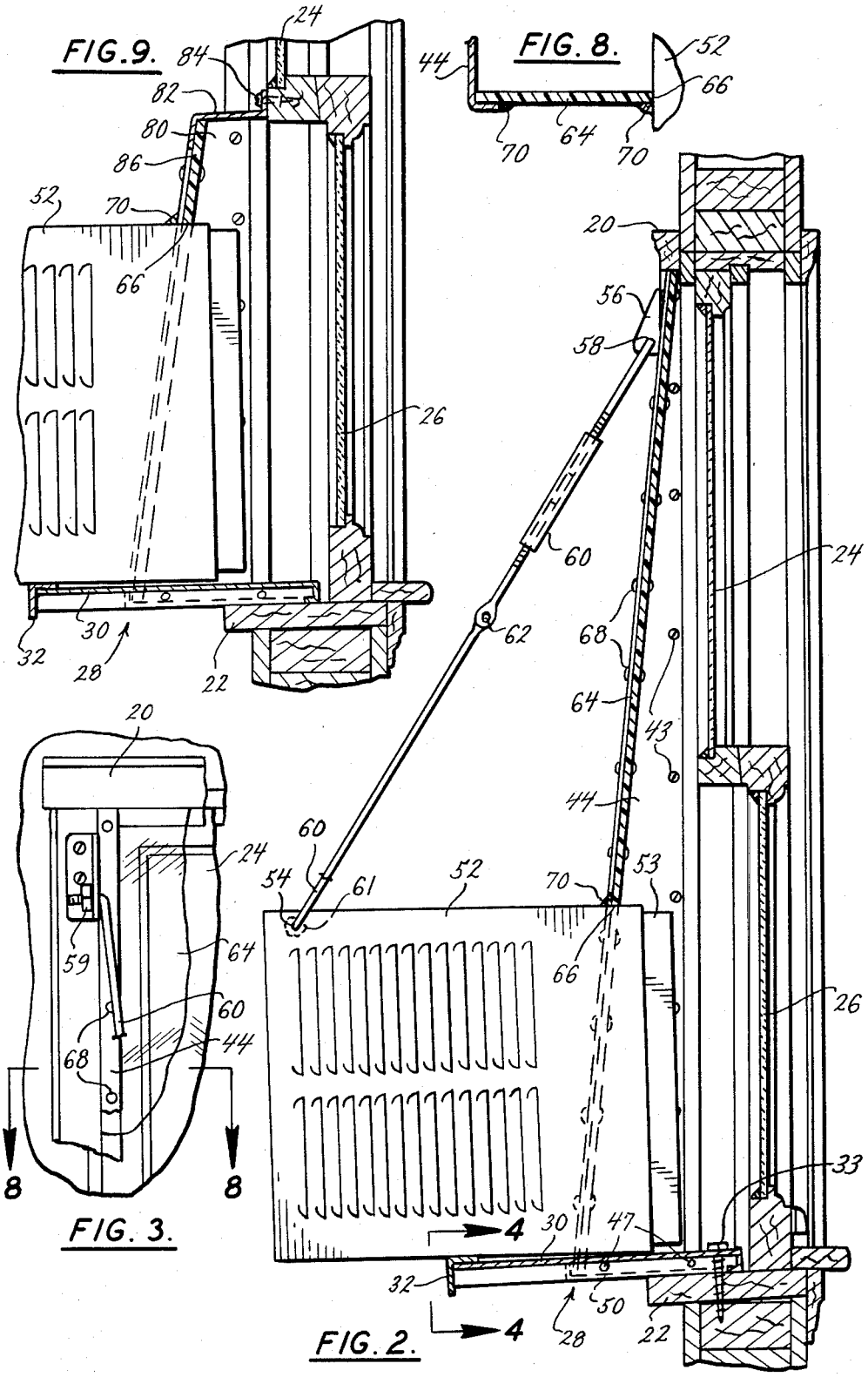
FIG. 2 is a sectional view, on a larger scale, which is taken along the plane indicated by the line 2—2 in FIG. 1.
FIG. 3 is a front elevational view, on a still larger scale, of a portion of the mounting shown in FIGS. 1 and 2.
FIG. 8 is a sectional view, on a scale intermediate the scales of FIGS. 3 and 5, which is taken along the plane indicated by the line 8—8 in FIG. 3.
FIG. 9 is a vertical section through a second preferred embodiment of mounting which is provided by the present invention.

Referring to the drawing in detail, the numeral 20 generally denotes part of the exterior window casing for a double-hung window of a building. The numeral 22 denotes the sill, the numeral 24 denotes the upper sash, and the numeral 26 denotes the lower sash for that double-hung window. That exterior window casing, that sill, and those sashes are of standard and usual design and are not, per se, parts of the present invention.

The numeral 28 generally denotes a platform which is part of the mounting provided by the present invention. That platform includes a horizontally disposed plate 30 which has a downwardly-depending flange at each side thereof and which has a downwardly-depending flange at the front thereof; and that front flange has a rearwardly-extending lip at its lower edge. The numeral 31 denotes one of a number of openings in plate 30 adjacent the front thereof; and that opening is shown in FIG. 6. The numeral 32 denotes an angle iron which is welded, or otherwise secured, to the upper side of the rear edge of plate 30, and hence constitutes an integral part of platform 28. The angle iron 32 is longer than plate 30 is wide; and the outwardly-projecting ends of that angle iron have openings 34 therein. The downwardly-turned flanges on plate 30 coact with angle iron 32 to make platform 28 sturdy and rugged and well able to support a window-type air conditioning unit 53 and the housing 52 therefor. Lag screws 33 will extend downwardly through the openings 31 in plate 30 and seat in the sill 20 to fix the position of that platform relative to the double-hung window. The plate 30 and the angle iron 32 preferably are made from a sturdy metal such as steel.

The numeral 36 denotes an elongated plate which has the form of a right triangle and which has an altitude-edge that is many times greater than the base-edge thereof. That plate has a flange along the hypotenuse-edge thereof, as shown particularly by FIGS. 1 and 6; and that flange should be about one-half ($\frac{1}{2}$) of an inch wide. Openings 38 are provided along the altitude-edge of that plate, openings 40 are spaced along the base-edge of that plate, and openings 42 are provided in the hypotenuse-edge of that plate. The numeral 44 denotes an elongated plate which is a mirror image of plate 36. Screws 43 pass through the openings 38 and seat in the confronting inner faces of the frame of the double-hung window to secure the side plates 36 and 44 to those faces, as shown by FIGS. 1 and 2.

The numeral 46 denotes a filler plate which has upstanding flanges at its outer edge and at one end, as shown particularly by FIG. 6. Openings 48 are provided in the end flange; and those openings can be set in register with the openings 40 in the base-edge of side plate 36. The numeral 50 denotes a filler plate which is the mirror image of the filler plate 46. The openings 48, not shown, in filler plate 50 can be set in register with the openings 40 in the base-edge of side plate 44. Fasteners 51, which can be bolts and nuts or self-tapping screws or pop rivets, are seated in the openings 48 in the filler plates 46 and 50 and in the openings 40 in the plates 36 and 44 to secure those filler plates to the plates 36 and 44.

In the preferred embodiment of the present invention, the filler plates 46 and 50 and the plates 36 and 44 will be made from relatively-thin sheets of aluminum. As a result, those ends of those filler plates which are to be disposed adjacent the sides of plate 30 can easily be cut and then bent upwardly to form upstanding flanges which can abut the downwardly-depending side flanges of plate 30. The sum of the lengths of filler plates 46 and 50 and of the width of plate 30 should substantially equal the distance between the confronting inner faces of the frame of the double-hung window. By making the plate 30 fourteen (14) inches wide, and by making the initial length of each of the filler plates 36 and 44 about eighteen (18) inches, the present invention enables the mounting to be used with any double-hung window that has a width in the range of twenty to forty-five (20–45) inches. After the ends of filler plates 46 and 50, which are to be disposed adjacent the sides of plate 30, have been cut and bent upwardly, openings 49 can be formed in those upwardly-bent cut ends. Corresponding openings, not shown, will be formed in the downwardly-extending flanges at the sides of plate 30; and fasteners 47 can be disposed in those openings to solidly secure those filler plates to the platform 28. As a result, those filler plates and that platform provide a substantially-continuous, solid surface which is adjacent to, overlies, and extends outwardly beyond, the sill 22, as shown particularly by FIGS. 1 and 4. If any of the plates 30, 36, 44, 46 and 50 is made of a metal which could respond to moisture to develop an electrolytic action with another of those plates, suitable anti-corrosion treatments or barriers should be provided for that plate and the other plate. All of those plates should be substantially impervious to air.

The numeral 54 denotes openings adjacent the upper rear corners of the side walls of the housing 52 for the air conditioning unit 53. Those openings are located above the level of, and out of register with, all portions of that air conditioning unit.

The numeral 55 denotes fasteners which extend downwardly through openings, not shown, in the bottom of the housing 52 and which are in register with the openings 34 in the angle iron 32. Those fasteners will fixedly secure the housing 52 against movement relative to the platform 28. If it should ever become desirable to provide additional fasteners to prevent shifting of that housing relative to that platform, further openings could be provided in the bottom of that housing and in plate 30 to accommodate further fasteners 55. Those openings should be located so they could not interfere with ready telescoping of the air conditioning unit 53 into and out of the housing 52.

The numeral 56 denotes brackets which are L-shaped in plan, and which have openings that can accommodate wood screws. Those wood screws will pass through those openings and seat in the outer faces of the frame of the double-hung window to solidly hold brackets 56 in assembled relation with those outer faces. Each of those brackets has an opening 58 therein to accommodate the upper end of a turnbuckle 60. Nuts 59 are threaded onto those upper ends to prevent separation of those ends from brackets 56. The lower ends of those turnbuckles extend inwardly through the openings 54 in the housing 52; and nuts 61 are threaded onto those lower ends to prevent separation of those ends from that housing. Each of the turnbuckles 60 has a pin joint 62 intermediate the ends thereof. Those pin joints are in register with each other; and they define an axis about which the lower and upper portions of those turnbuckles can be rotated relative to each other.

The numeral 64 denotes a sheet of substantially air-impervious material. That sheet preferably will be made from a transparent or transluscent plastic material; and one such material is an acrylic plastic. If desired, all or part of that sheet can be tinted to reduce the transmission of solar heat through it. Also, if desired, that sheet could be made of metal, plywood or other opaque material. The numeral 66 denotes a large rectangular notch in the bottom edge of the sheet 64; and that notch is dimensioned to closely accommodate the front portion of the housing 52 for the air conditioning unit 53. The side edges of sheet 64 have openings therein which can be aligned with the openings 42 in the hypotenuse-edge flanges of side plates 36 and 44 to accommodate fasteners 68. Those fasteners could be nuts and bolts or self-tapping metal screws or pop rivets. The numeral 70 denotes caulk which seals the joints between the filler plates 46 and 50 and the lower edge of sheet 64, between the notch 66 and the sides and top of housing 52, and between the sheet 64 and the plates 36 and 44, as shown particularly by FIGS. 2, 5 and 8. Also, caulk 70 will seal the space between the sides of plate 30 and the bottom of housing 52, will seal the joints between angle iron 32 and housing 52, will seal the joint between the upper edge of sheet 64 and the frame of the double-hung window, and will seal any other space or joint which should be sealed. If desired, the caulk 70 could be applied at the inner face, rather than at the outer face, of sheet 64.

It will be noted that platform 28 holds the housing 52 and the air conditioning unit 53 wholly outwardly of both tracks of the double-hung window. As a result, either or both of the upper and lower sash 24 and 26 can be moved away from closed position. When the lower sash 26 is raised so the lower portion thereof is adjacent the top of air conditioning unit 53, cold air from that air conditioning unit can fully and freely pass into the room of which the window is a part. Also, return air for that air conditioning unit can fully and freely pass to the return-air inlet for that air conditioning unit. If desired, the bottom of upper sash 24 could be set close to the upper edge of air conditioning unit 53, and the lower sash 26 could be set adjacent the top of the double-hung window sash. Such a setting would minimize aspiration of un-cooled air inwardly through the window with the cold air from air conditioning unit 53.

The plates 36 and 44, the plate 30, the filler plates 46 and 50, the housing 52, the sheet 64, and the caulk 70 will keep wind—even very heavy wind—from causing hot or cold air to move into the room through the lower portion of the double-hung window. Also, those plates, that housing, that sheet and that caulk will coact with upper sash 24 and portions of lower sash 26 to define an insulating air space. As a result, although the air conditioning unit 53 is mounted so it is wholly external of both tracks of the double-hung window, cooled air can freely pass into the room, return-air can freely move out of the room to the return-air inlet of that air-conditioning unit, and an insulating mass of air will be provided adjacent the upper sash 24 and part of the lower sash 26.

Whenever the air-conditioning unit 53 is not in operation, the upper sash 24 and the lower sash 26 can be set in the positions shown by FIG. 2. At such time, the substantial air-tight integrity of the window is assured by those sash. In addition, a mass of insulating air will be held exteriorly of, but immediately adjacent, the sash 24 and 26 to help insulate the interior of the room from the ambient heat or cold.

Where the window is close to the ground, the installer can do part of the installation work for the mounting of FIGS. 1–8 while he is external of the room, and can do the rest of that installation work while he is within that room. Where the window is part of a room that is located well above ground level, the mounting of FIGS. 1–8 can be installed wholly from within the room. In either event, the installer will, if a room cooler is mounted within or adjacent the window, completely remove that room cooler. In the event no room cooler is disposed within or immediately adjacent the window, but a storm window is mounted adjacent that window, that storm window will be removed. The installer will then make sure that both the upper sash 24 and the lower sash 26 freely move up and down within the tracks therefor. Thereupon, the installer will determine the maximum dimensions of the sheet 64 and will obtain that sheet.

At this time, the installer will drill holes for the screws that will be used to hold the brackets 56 in position. Thereafter, those screws will be used to solidly secure those brackets in the positions shown by FIGS. 1–3. The upper sections of the turnbuckles 60 will have the threaded ends thereof passed through the openings 58 in the brackets 56, and then will have the nuts 59 threaded onto those ends. Those nuts will permit rotation of those upper sections relative to the brackets 56 but will prevent accidental separation of those upper sections from those brackets. The lower sections of the turnbuckles 60 will then be secured to the upper section; and those turnbuckles will be permitted to hang downwardly adjacent the sides of the frame of the double-hung window.

The plates 36 and 34 will be disposed at the inner faces of the frame for the double-hang window; and the altitude edges of those plates will be set close to the outer portions of the tracks for the upper sash 24. The openings 28 adjacent those altitude edges will be used to mark the locations of the holes for the screws 43. After those holes have been drilled, the screws 43 will be used to solidly secure the plates 36 and 34 to the inner faces of the frame for the double-hung window. Although the altitude edges of those plates will be close to the outer portions of the tracks for the upper sash 24, they will be set so they will not interfere with movement of that sash into, out of, and between its upper and lower positions.

At this time, the installer will assemble the housing 52 with the platform 28. In doing so, the installer will use the openings 31 in plate 30 as guides in marking the positions of the openings to be formed in the bottom of that housing. Thereafter, holes of the desired size will be formed in the bottom of housing 52 to accommodate the lag screws 33. Also, openings will be formed in the bottom of housing 52 to accommodate the fasteners 55; and then those fasteners will be used to secure that housing to platform 28. Thereafter, the filler plates 46 and 50 will be cut, and upstanding flanges will be formed at the cut ends. After the openings 49 have been formed in those flanges and corresponding openings have been formed in the downwardly-depending flanges at the sides of plate 30, the fasteners 47 will be used to secure the filler plates 46 and 50 to the platform 28. At this time, holes will be formed in the upper surface of the sill 22 at points which will underlie the openings 31 in the plate 30 when the platform 28 is set in position atop that sill. Those openings will accommodate finish nails which can be used as locating pins.

The openings 54 will then be formed in the side walls of the housing 52. Thereupon, that housing will be rested on the sill 22 with the inner end thereof disposed well inwardly of the position shown by FIGS. 1 and 2. At this time, the threaded inwardly-directed ends of the lower portions of the turnbuckles 60 will be passed through the openings 54; and then the nuts 61 will be threaded onto those inner ends to prevent accidental separation of the turnbuckles from housing 52 while permitting ready rotation of those lower sections relative to that housing. The pin joints 62 adjacent the midpoints of those turnbuckles will permit the lower sections of those turnbuckles to be set at obtuse angles relative to the upper sections of those turnbuckles while those lower sections are being assembled with the housing 52. Thereafter, the housing 52 and the attached platform 28 will be moved outwardly relative to the window until the openings 31 are telescoped over the finish nails which act as locating pins. Those finish nails will then be successively removed and replaced by the lag screws 33 to solidly secure the platform 28 to the sill 22. At this time, the rotatable, internally-threaded, sleeve-like portions of the turnbuckles 60 can be rotated to cause the housing 52 to assume a position which will facilitate the drainage of condensate from that housing. Once the platform 28, with the filler plates 46 and 50 attached thereto and with the housing 52 secured thereon, has been solidly secured to the sill 22 and the desired lengths have been provided for the turnbuckles 60, the fasteners 51 will be mounted within the openings 40 in the plates 36 and 44 and in the openings 48 in the filler plates 46 and 50. At this time, the dimensions of the sheet 64 will be checked relative to the space defined by the hypotenuse edges of the plates 36 and 44. If the length of that sheet exceeds the length of either of those hypotenuse edges, either the top or bottom of that sheet will be cut to make the overall length of that sheet substantially equal the length of one of those hypotenuse edges. If the width of that sheet exceeds the distance between the confronting faces of those hypotenuse edges, one or the other elongated edges of that sheet will be cut to make the width of that sheet about one-eighth ($\frac{1}{8}$) inch smaller than the distance between those confronting faces. Also, the notch 66 will be formed in the lower edge of the sheet 64.

Thereupon, both the upper sash 24 and the lower sash 26 will be set in their lowermost positions, and the lower end of the sheet 64 will be passed outwardly and downwardly through the portion of the window opening normally occupied by that upper sash. If necessary, that sheet can be bowed along one or more horizontal lines to facilitate its passage through the portion of the window that is normally occupied by the upper sash 24 and then downwardly into position where the edges of the notch 66 confront and are immediately adjacent the top and sides of the housing 52. At such time, the fasteners 68 will be used to secure the edges of sheet 64 to the flanges at the hypotenuse edges of the plates 36 and 44. Caulk 70 will then be applied to seal the various spaces and joints through which air could otherwise pass. Finally, the air-conditioning unit 53 will be telescoped into the housing 52 and all trim strips and other ornamental parts of that air-conditioning unit will be installed.

The inner edges of that air-conditioning unit and that housing will receive support from the inner edge of plate 30 of platform 28, and the outer edges of that air-conditioning unit and housing will receive support from the turnbuckles 60. As a result, that air-conditioning unit will be solidly supported, even though it is wholly external of both tracks of the double-hung window.

The electric cord of the air-conditioning unit 53 will be passed inwardly through the lower portion of the window and will be connected to an adjacent outlet whenever that air-conditioning unit is to be operated. When the upper and lower sash 24 and 26 are to be closed, that electric cord will be moved into the space intermediate the inner face of that air-conditioning unit and the outer face of the lower sash 26 so that lower sash can be moved to the closed position shown by FIG. 2.

The present invention obviates all need of buying a room cooler cover. Further, the present invention obviates all of the maintenance costs which are involved in installing and removing and, occasionally, in repairing, such a cover. Moreover, the present invention obviates all of the costs involved in bodily removing the air-conditioning unit and its housing from the window each fall and in re-mounting that unit and housing each spring. Additionally, the present invention provides a mass of insulating air adjacent the window whether the upper and lower sash are in their fully-closed, fully-open, or partially-open positions.

Referring particularly to FIG. 9, the numerals 22, 24, 26, 28, 30, 32, 52 and 70 denote components which can, and preferably will, be identical to correspondingly-numbered components in FIGS. 1–8. The numeral 80 denotes a plate which is similar to the lower half of the plate 44; and plate 80 will be secured to the inner face of one side of the double-hung window. A mirror image plate, not shown, which will be similar to the lower half of the plate 36, will be mounted in a position comparable to the position occupied by the lower half of plate 36.

The numeral 82 denotes a top plate which has an upwardly-extending inner flange and a downwardly-extending outer flange; and screws 84 extend through that upwardly-extending flange to seat in the lower portion of upper sash 24. The numeral 86 denotes a sheet which is similar to the lower half of sheet 64; and sheet 86 will have a notch 16, which will be comparable to the notch 66 in the sheet 64. The notch in sheet 86 will closely confront the sides and top of housing 52, the sides of that sheet will be disposed inwardly of, but immediately adjacent, the hypotenuse-edge flanges on plate 80 and on its mirror image, and the top of that sheet will underlie and be immediately adjacent top plate 82.

The air-conditioning unit 53 within the housing 52 of FIG. 9 will, like the air-conditioning unit 53 of FIGS. 1–8, be disposed wholly externally of both tracks of the double-hung window. Consequently, the lower sash 26 can be freely moved into and out of its closed position. When that sash 26 is open, cold air can flow from the air-conditioning unit 53 into the room, and return air from that room can flow to the return-air inlet of that air-conditioning unit. The plate 30, the filler plates 46 and 50, plate 80 and its mirror image, top plate 82, sheet 86, and caulk 70 will keep wind—even very heavy wind—from causing hot or cold air to pass inwardly through the window. When the lower sash 26 is closed, as when the air-conditioning unit 53 is not being used, the air which is confined by that lower sash, sheet 86, the plate 30, the filler plates 46 and 50, plate 80 and its mirror image, and top plate 82 will help insulate the interior of the room from ambient heat or cold.

The mounting of FIG. 9 can be set in place by an installer who does part of the installation work while he is outside the room and does the rest of that installation work while he is in that room. However, by bowing sheet 86 along one or more horizontal lines, it is possible to install the mounting of FIG. 9 while the installer is wholly within the room.

If desired, the sheets 64 and 86 could have standard-size notches indicated on the lower portions thereof by painted, printed, scored, perforated or other lines. Such lines would help an installer cut the desired-size notch for any standard-size housing 52. The notch for any other size housing could be readily determined and then cut by the installer.

FIGS. 1, 2 and 9 show the air-conditioning unit 53 disposed wholly external of both tracks of the double-hung window. However, if desired, those air-conditioning units could be disposed so they extended inwardly of the track for upper sash 24 but were wholly external of the track for lower sash 26.

FIGS. 1 and 2 show the turnbuckles 60 extending between the brackets 56 and the housing 52. If desired, those turnbuckles could extend between those brackets and extensions of the angle iron 32 which projected beyond the sides of housing 52.

If desired, the sheet 64 could be constituted by an upper section and a lower section. In such event, the lower end of the upper section should lap the outer face of the upper end of the lower section.

Whereas the drawing and accompanying description have shown and described two preferred embodiments of the present invention, it should be apparent to those skilled in the art that various changes may be made in the form of the inventon without affecting the scope thereof.

What I claim is:

1. A space-defining mounting, for a window-type air-conditioning unit that is disposed adjacent a sash-equipped window of a building and that has a vented protective housing and that has all portions thereof other than the electric cord disposed wholly outwardly of the lower sash of said window, which comprises a platfrom that is securable in a position, adjacent the lower portion of said window, wherein all portions of said platform are disposed wholly outwardly of said lower sash of said window and wherein said platform has a portion thereof extending outwardly from said building to underlie and help support said air-conditioning unit, horizontally-spaced vertically-directed, substantially air-impervious side members that are disposable adjacent the opposite sides of said window and that have all portions thereof disposed outwardly of said lower sash of said window, said side members having lower portions that will be disposed wholly inwardly of the vents in said housing for said air-conditioning unit and that will be coextensive in part with portions of said housing for said air-conditioning unit, and a substantially air-impervious member which is disposable immediately adjacent portions of said housing for said air-conditioning unit that are disposed inwardly of said vents in said housing for said air-conditioning unit and which is extendable outwardly and upwardly from said housing for said air-conditioning unit toward said side members, said platform and said side members and said substantially air-impervious member being adapted to coact with said lower sash for said window and with said housing for said air-conditioning unit, whenever said lower sash is in its closed position, to help define an insulating air space that is external of, but that is close to, said lower sash, said platform and said side members and said substantially air-impervious member being adapted to coact with said housing for said air-conditioning unit to provide a barrier to the elements when said lower sash is raised to permit operation of said air-conditioning unit.

2. A space-defining mounting is claimed in claim 1 wherein said substantially air-impervious member is inclinable outwardly and downwardly relative to said window, and wherein said substantially air-impervious member has a notch in the bottom edge thereof which can accommodate said housing for said air-conditioning unit.

3. A space-defining mounting as claimed in claim 1 wherein tension members are connectable to said housing, at points spaced outwardly of said substantially air-impervious member, and are extendable upwardly and inwardly toward said window to be secured to said building to help support the weight of the outer portion of said air-conditioning unit.

4. A space-defining mounting as claimed in claim 1 wherein tension members are connectable to said housing, at points spaced outwardly of said substantially air-impervious member, and are extendable upwardly and inwardly toward said window to be secured to said building to help support the weight of the outer portion of said air-conditioning unit, and wherein said tension members can be given alinear configurations as said housing for said air-conditioning unit is moved horizontally relative to said platform.

5. A space-defining mounting as claimed in claim 1 wherein said substantially air-impervious member has a notch in the bottom edge thereof which can accommodate said housing for said air-conditioning unit, wherein said housing for said air-conditioning unit coacts with said notch to help confine and position said substantially air-impervious member, and wherein flanges at the outer edges of said side members can help confine and position said substantially air-impervious member.

6. A space-defining mounting as claimed in claim 1 wherein said side members are generally triangular, wherein said side members have the base edges thereof disposable adjacent the sill of said window, and wherein said substantially air-impervious members make said insulating space generally triangular in cross section.

7. A space-defining mounting as claimed in claim 1 wherein inner portions of said platform are securable to the sill of said window, wherein the outer portions of said platform are securable to said housing for said air-conditioning unit, and wherein tension members are connectable to said housing, at points spaced outwardly of said substantially air-impervious member, and are extendable upwardly and inwardly from said housing toward said window to be secured to said building to help support the weight of the outer portion of said air-conditioning unit.

8. A space-defining mounting as claimed in claim 1 wherein tension members are connectable to said housing, at points spaced outwardly of said substantially air-impervious member, and are extendable upwardly and inwardly toward said window to be secured to said building to help support the weight of the outer portion of said air-conditioning unit and wherein said tension members are adjustable-length tension members to facilitate setting of said air-conditioning unit at a desired angle to the horizontal.

9. A space-defining mounting, for a window-type air-conditioning unit that is disposed adjacent a sash-equipped window of a building and that has a vented protective housing and that has all portions thereof other than the electric cord disposed wholly outwardly of the lower sash of said window, which comprises a platform that is securable in a position, adjacent the lower portion of said window, wherein said platform has a portion thereof extending outwardly from said building to underlie and help support said air-conditioning unit, horizontally-spaced vertically-directed, substantially air-impervious side members that are disposable adjacent the opposite sides of said window and that have all portions thereof disposed outwardly of said lower sash of said window, said side members having lower portions that will be disposed wholly inwardly of the vents in said housing for said air-conditioning unit and that will be coextensive in part with portions of said housing for said air-conditioning unit, and a substantially air-impervious member which is disposable immediately adjacent portions of said housing for said air-conditioning unit that are disposed inwardly of said vents in said housing for said air-conditioning unit and which is extendable outwardly and upwardly from said housing for said air-conditioning unit toward said side members, said platform and said side members and said substantially air-impervious member being adapted to coact with said lower sash for said window and with said housing for said air-conditioning unit, whenever said lower sash is in its closed position, to help define an insulating air space that is external of, but that is close to, said lower sash, said substantially air-impervious member being inclinable outwardly and downwardly relative to said window, tension members connectable to said housing, that are extendable upwardly and inwardly toward said window to be secured to said building to help support the weight of the outer portion of said air-conditioning unit, and said tension members being disposable laterally outwardly of said substantially air-impervious member.

* * * * *